US006475128B1

(12) United States Patent
Wallace et al.

(10) Patent No.: US 6,475,128 B1
(45) **Date of Patent: *Nov. 5, 2002**

(54) APPARATUS AND METHOD FOR INDIVIDUALLY CONTROLLING MOTORS IN A CARTON FOLDING MACHINE IN ORDER TO AUTOMATICALLY EXECUTE A CARTON FOLDING PROCESS

(75) Inventors: Michael D. Wallace, Mooringsport, LA (US); Ronald J. Montgomery, Keithville, LA (US)

(73) Assignee: J&L Development, Inc., Keithville, LA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/320,162

(22) Filed: May 26, 1999

(51) Int. Cl.[7] ..... B31B 1/00
(52) U.S. Cl. ..... 493/8; 493/23; 493/405
(58) Field of Search ..... 493/23, 3, 8, 405; 53/55

(56) References Cited

U.S. PATENT DOCUMENTS

| | | | | |
|---|---|---|---|---|
| 3,330,185 A | | 7/1967 | Annett et al. | 93/49 |
| 3,797,368 A | * | 3/1974 | Martelli | 493/197 |
| 3,901,134 A | | 8/1975 | Reizenstein et al. | 93/49 AC |
| 4,119,018 A | | 10/1978 | Nava | 93/49 |
| 4,279,611 A | | 7/1981 | Labombarde et al. | 493/418 |
| 4,432,745 A | | 2/1984 | Eldridge | 493/10 |
| 4,539,002 A | | 9/1985 | Zak | 493/23 |
| 4,604,083 A | * | 8/1986 | Barny et al. | |
| 4,683,704 A | | 8/1987 | Vorachek et al. | 53/461 |
| 4,715,846 A | | 12/1987 | Zak | 493/10 |
| 4,736,569 A | | 4/1988 | Hudson et al. | 53/374 |
| 4,747,813 A | | 5/1988 | Genoud et al. | 493/10 |
| 4,990,128 A | | 2/1991 | Murrah | 493/133 |
| 5,151,075 A | | 9/1992 | Beaulleu et al. | 493/179 |
| 5,152,734 A | | 10/1992 | McAdam, III et al. | 493/10 |
| 5,267,933 A | | 12/1993 | Precoma | 493/23 |
| 5,352,177 A | * | 10/1994 | Walter | 493/23 |
| 5,358,464 A | | 10/1994 | Funk et al. | 493/320 |
| 5,530,323 A | | 6/1996 | Breitzmann | 318/85 |
| 5,634,323 A | | 6/1997 | Podsiadlo | 53/484 |
| 5,699,735 A | * | 12/1997 | Stein et al. | 493/405 |
| 5,749,823 A | * | 5/1998 | Richards | 493/23 |
| 5,782,734 A | | 7/1998 | Reuteler | 493/313 |
| 5,864,484 A | * | 1/1999 | Harding | |

OTHER PUBLICATIONS

File History of U.S. Patent No. 4,715,846.
Indramat Reference Manual, Table of Contents, CLC Multi–Axis Coordinated Motion Control (1991, 1994, 1995, 1996).
Indramat Reference Manual, Index (1996).
Indramat Reference Manual, Chapter 6. Icon Programming (1996).
Indramat Start–Up Guide, CLC Multi–Axis Coordinated Motion Control (1997).

* cited by examiner

*Primary Examiner*—Eugene Kim
(74) *Attorney, Agent, or Firm*—Dorsey & Whitney LLP

(57) ABSTRACT

A controller for providing individual acceleration and velocity values to drivers controlling motors in a carton folding machine. In a first method, the controller provides the individual acceleration and velocity values by using unique addresses for each motor. The drivers receive the values and provide corresponding motor control signals to the motors they control. In a second method, the controller provides a master reference signal to the drivers along with acceleration and velocity values for the motors. The drivers generate electronic gear ratios for providing motor control signals to the motors they control based upon the master reference signal.

24 Claims, 7 Drawing Sheets

APPARATUS AND METHOD FOR INDIVIDUALLY CONTROLLING MOTORS IN A CARTON FOLDING MACHINE IN ORDER TO AUTOMATICALLY EXECUTE A CARTON FOLDING PROCESS

REFERENCE TO RELATED APPLICATION

The present application is related to United States Patent application of Michael D. Wallace and Ronald J. Montgomery, entitled "Apparatus and Method for Folding a Back Flap of a Carton," and filed on Apr. 21, 1999, which is incorporated herein by reference as if fully set forth.

TECHNICAL FIELD

The present invention relates to an apparatus and method for individually controlling motors in a carton folding machine.

BACKGROUND

Folding of cartons from cardboard blanks requires certain apparatus within a carton folding machine. The apparatus includes several sections, each section performing a different operation for a folding process. Each section is controlled by its own motor, and the motors among the sections must operate at particular speeds in order for the sections to cooperatively work in sequence to perform the folding process. The machine may use a master reference signal to drive all of the motors. In order to adjust each motor for its own particular speed requirements, mechanical gearing may be used to generate the particular speed based upon the master reference signal. Use of mechanical gearing may be difficult to easily adjust for different speed requirements and it provides additional moving mechanical components to the machine, increasing its complexity.

Accordingly, a need exists for an improved apparatus for controlling motors in a carton folding machine.

SUMMARY

Methods and apparatus consistent with the present invention provide for transmitting individual velocity signals for controlling motors in a carton folding machine, or transmitting signals used to generate the velocity signals based upon a master reference signal.

A first method and apparatus include receiving values of velocity parameters relating to controlling a plurality of motors within a carton folding machine. Motor control signals are automatically generated from the velocity values for individually controlling the plurality of motors, and the motor control signals are automatically transmitted to the plurality of motors in order to control the motors for automatically executing a process of folding a carton through the carton folding machine.

A second method and apparatus include receiving a master reference signal and values of velocity parameters for controlling a plurality of motors within a carton folding machine. Ratios are automatically determined from the master reference signal and the values and motor control signals are automatically generated from the master reference signal, using the ratios, for individually controlling the plurality of motors. The motor control signals are automatically transmitted to the plurality of motors in order to control the motors for automatically executing a process of folding a carton through the carton folding machine.

BRIEF DESCRIPTION OF THE DRAWINGS

The accompanying drawings are incorporated in and constitute a part of this specification and, together with the description, explain the advantages and principles of the invention. In the drawings.

DETAILED DESCRIPTION

Systems consistent with the present invention use individual electronic acceleration or velocity signals, or electronic gear ratios to control motors in a carton folding machine. The individual acceleration and velocity signals are separately transmitted to drivers for the motors and include values from which the drivers may generate individual signals to control velocity and acceleration of the associated motors. The electronic gear ratios may also be individually transmitted to the drivers and provide values from which the drivers may translate a master reference signal into individual signals controlling velocity and acceleration of the associated motors. Both of these techniques avoid the use of mechanical gear ratios and the complexities of it, although mechanical gear ratios may be used in conjunction with these techniques, if desired.

Figure 1A:
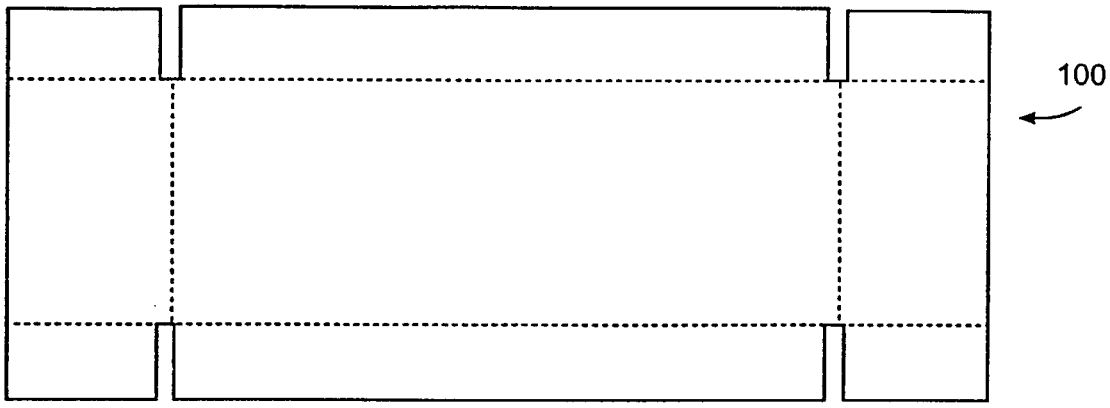
FIGS. 1A, 1B, and 1C are diagrams of exemplary cartons for assembly in a carton folding machine.
Figure 1B:
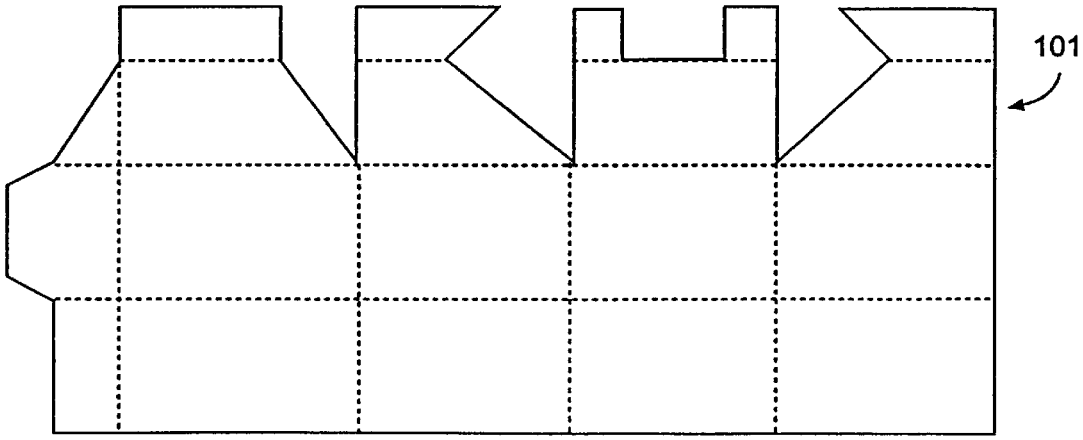
Figure 1C:
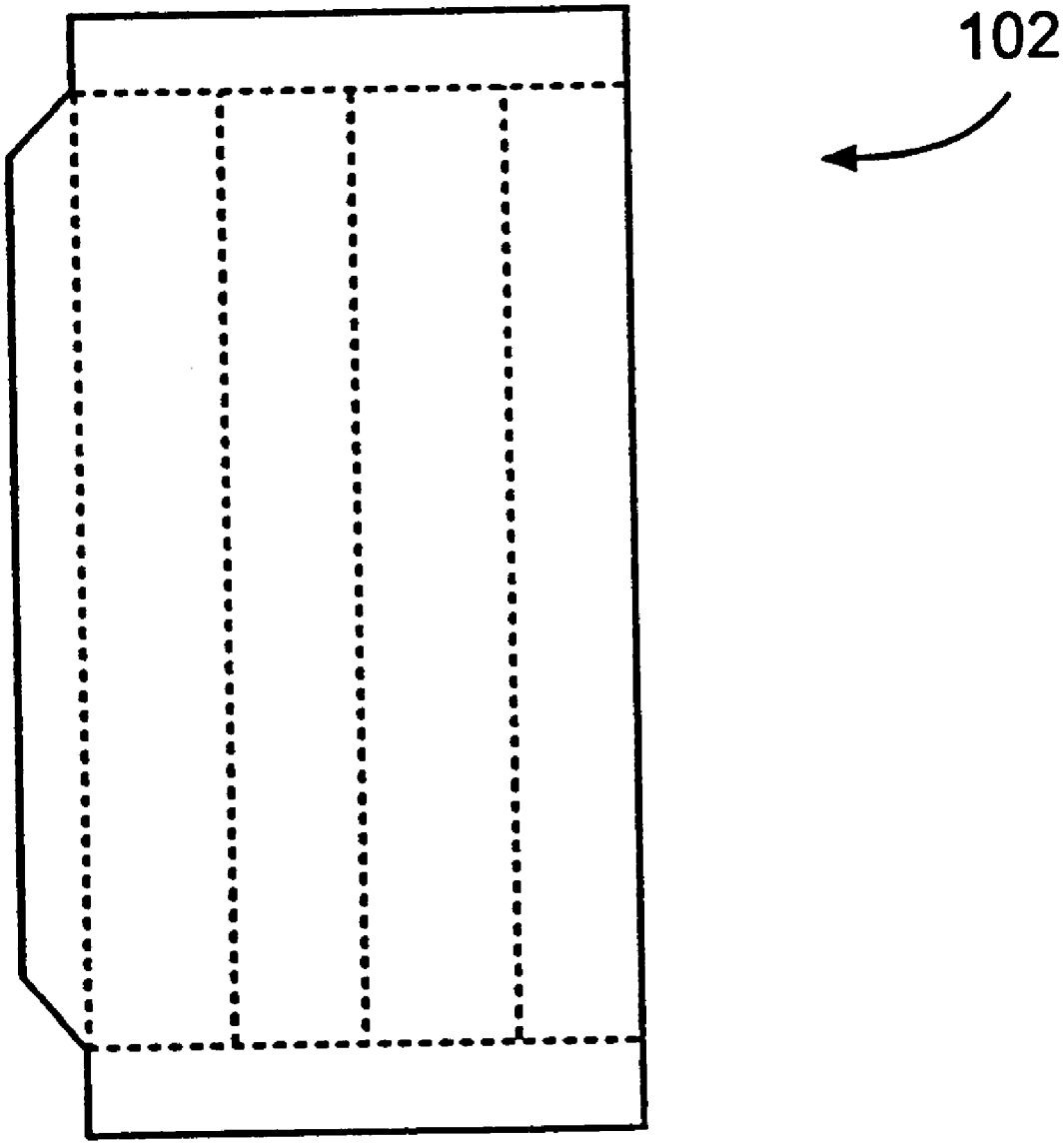

FIGS. 1A, 1B, and 1C are diagrams of exemplary cartons for assembly in a carton folding machine. FIG. 1A illustrates a four corner tray carton 100. FIG. 1B illustrates a snaplock carton 101. FIG. 1C illustrates a tube carton 102. These exemplary cartons include score lines, indicated by the dashed lines, separating the cartons into sections including at least one back flap. A carton folding machine folds the cartons about the score lines in order to assemble them, and the manner in which cartons are folded is known in the art and depends upon the configuration of each particular carton. In addition to the cartons shown in FIGS. 1A, 1B, and 1C, other types of cartons may be used, the folding of which depends upon their particular configuration. The term carton refers to any article to be folded; examples include, but are not limited to, unassembled or partially assembled boxes or other containers, composed of cardboard, paper, or any material capable of being folded.

Motor Control System

Figure 2:
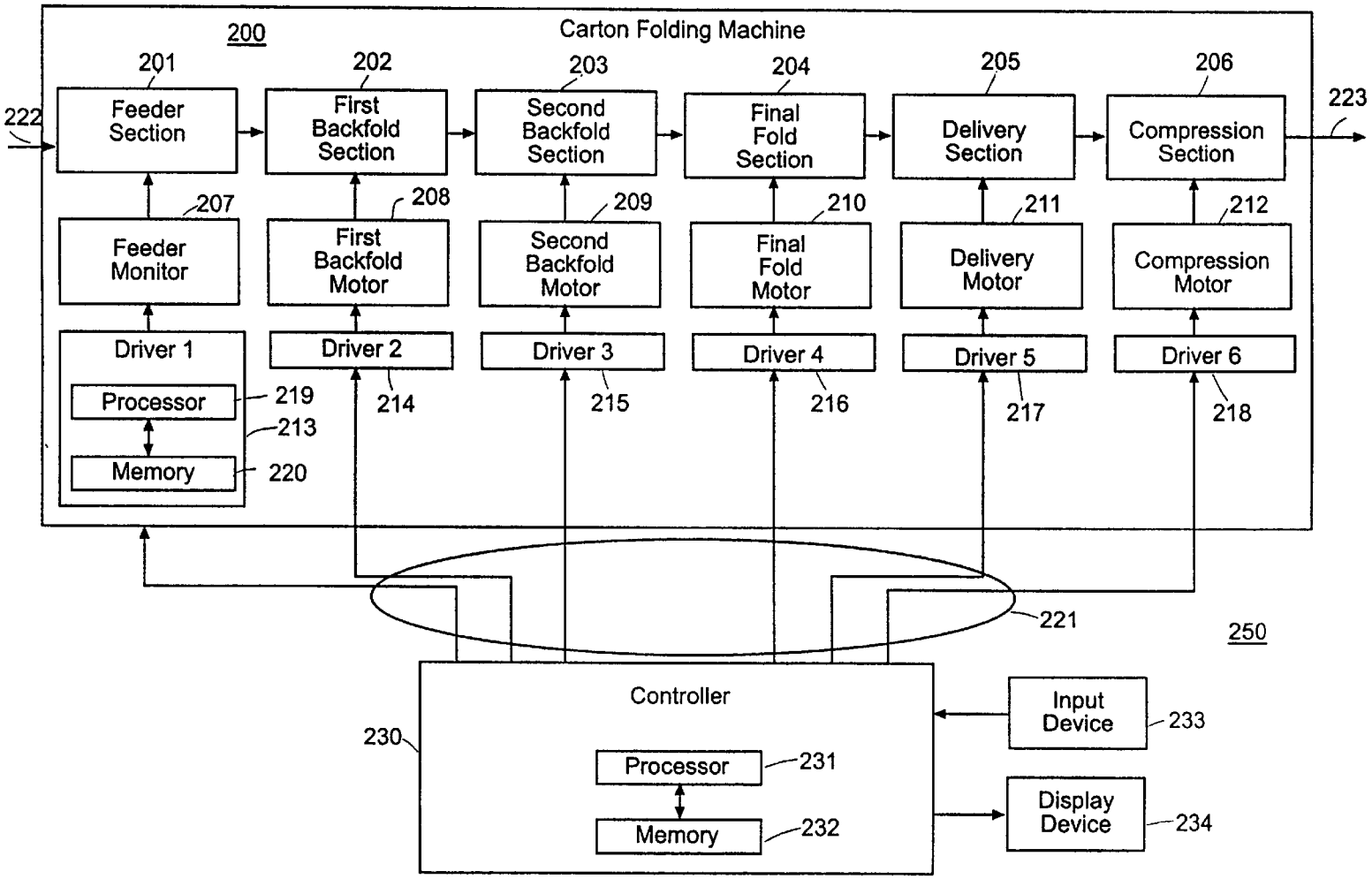
FIG. 2 is a diagram of a system for controlling motors in a carton folding machine.

FIG. 2 is a diagram of a system 250 for controlling motors in a carton folding machine 200. Machine 200 has a number of sections for performing a process of folding a carton, such as cartons 100–102. Each of the sections has an associated motor for controlling passage of the carton through each section using conveyors and other mechanical apparatus. A feeder section 201, connected to and controlled by a feeder motor 207, receives a carton on path 222 from stack of cartons; it peels the bottom carton in the stack and delivers the carton to machine 200. A first backfold section 202, connected to and controlled by a first backfold motor 208, receives the carton from feeder section 201 and it folds a first back flap of the carton, if required for assembly. A second backfold section 203, connected to and controlled by a second backfold motor 209, receives the partially folded carton from first backfold section 202 and it folds a second back flap of the carton, if required for assembly. A final fold section 204, connected to and controlled by a final fold section motor 210, receives the partially folded carton from second backfold section 203 with the back flaps folded, and final fold section 204 folds the carton over in half, creases it, and applies glue to it in order to complete the folding and assembly of it.

A delivery section 206, connected to and controlled by a delivery motor 211, receives the assembled carton from final fold section 205 and transfers the assembled carton along a conveyor to a compression section 206. Compression section 206, connected to and controlled by a compression motor 212, holds the assembled carton until the applied glue adequately dries to seal the carton, and it outputs the assembled carton on path 223. Each of the motors 207–212 may be implemented with any controllable electric motor, such as the Allen-Bradley servo motor. In addition, although each motor is shown controlling one section, each motor may control multiple sections, and each section may be controlled by multiple motors.

Each of the motors 207–212 includes an associated driver for controlling operation of the motor and thus operation of the corresponding section. A driver 213 is electronically connected to and controls feeder motor 207, and driver 213 includes a processor 219 coupled to a memory 220 for storing programs for execution by processor 219, data, or other information. The other motors likewise include associated drivers electronically connected to the motors for controlling them as follows: a driver 214 controls first backfold motor 208; a driver 215 controls second backfold motor 209; a driver 216 controls final fold motor 210; a driver 217 controls delivery motor 211; and a driver 218 controls compression motor 212. Drivers 214-218 also include processors and associated memories, as shown in driver 213.

Drivers 213–218 are each connected to a controller 230 via individual connections 221. Each of the connections 221 is interfaced with controller 230 via separate output ports or output connections, and each output connection has a unique address. The term address includes any identifier for use in transmitting a signal to a particular destination component. Controller 230 may store the addresses and an indication of the corresponding motors in a data structure in memory 232 or other location, such as shown in Table 1.

TABLE 1

| Address | Motor |
|---|---|
| Address 1 | Feeder motor |
| Address 2 | First backfold motor |
| Address 3 | Second backfold motor |
| Address 4 | Final fold motor |
| Address 5 | Delivery motor |
| Address 6 | Compression motor |

Using the addresses, controller 230 may individually transmit information on connections 221 to specific ones of drivers 213–218 for controlling motors 207–212. Connections 221 may each be implemented with any wireline or wireless connection for data communication. Alternatively, controller 230 may use a single connection, or fewer than one connection per driver, with multiplexing techniques to transmit individual signals to the drivers.

Controller 230 includes a processor 231 coupled to a memory 232 for storing programs for execution by processor 231, data, or other information. Processor 231 may execute programs in order for controller 230 to transmit control information to drivers 213–218 via the output connections coupled to connections 221. By transmitting control information to drivers 213–218, controller 230 hence controls associated motors 207–212 and sections 201–206 for a carton folding process, which involves the operation of folding a carton in a carton folding machine. Controller 230 also includes one or more input connections for receiving information from an input device 233. Input device 233 may be used to enter values for particular parameters into controller 230 for use by processor 231 in calculating signals to control motors 207–212. Input device 107 may be implemented with any type of peripheral device for entering information into a computer or computer-controlled device either through a wireline or wireless connection, and examples of input devices include a keyboard, keypad, touch-screen display device, switches, or a data connection device. Controller 230 may also include an output connection coupled to a display device 234 for providing a visual display of information to a user. Display device 234 may be implemented with any type of computer display such as a CRT or flat screen monitor.

Controllers used for controlling electric motors are known in the art. An example of a controller is the Indramat DDS drive used with the Indramat CLC card. For that exemplary controller, the CLC card implements controller 230 to receive information used to generate motor control signals for controlling motors 207–212. The DDS drive implements drivers 213–218 by remotely receiving the motor control signals from the CLC card via fiber optic cable and by generating the corresponding signals to control operation of motors 207–212 and thus sections 201–206. An advantage of this exemplary implementation is that one CLC card may provide signals to the multiple DDS drives located distance from the CLC card. Other examples of controllers include the 1394 servo-controller by Allen-Bradley Co. and the SC9000 drive by Pacific Scientific. Embodiments consistent with the present invention, however, may be implemented with any processor-controlled servo-controller or, alternatively, with a computer such as a personal computer.

An example of a carton folding machine is disclosed in U.S. Pat. No. 5,151,075, which is incorporated herein by reference as if fully set forth. That patent includes an example of an implementation of sections 201–206. Embodiments consistent with the present invention may be used with any type of carton folding machine for automatically folding cartons as they move through the machine.

First Embodiment: Signal Addressing

A first embodiment uses addresses of the drivers or associated motors for transmitting individual velocity and acceleration signals to each driver. An exemplary method and apparatus for using signal addressing includes receiving values of velocity parameters relating to controlling a plurality of motors within a carton folding machine. Motor control signals are determined from the velocity values for individually controlling the plurality of motors, and the motor control signals are provided to the plurality of motors.

Figure 3A:
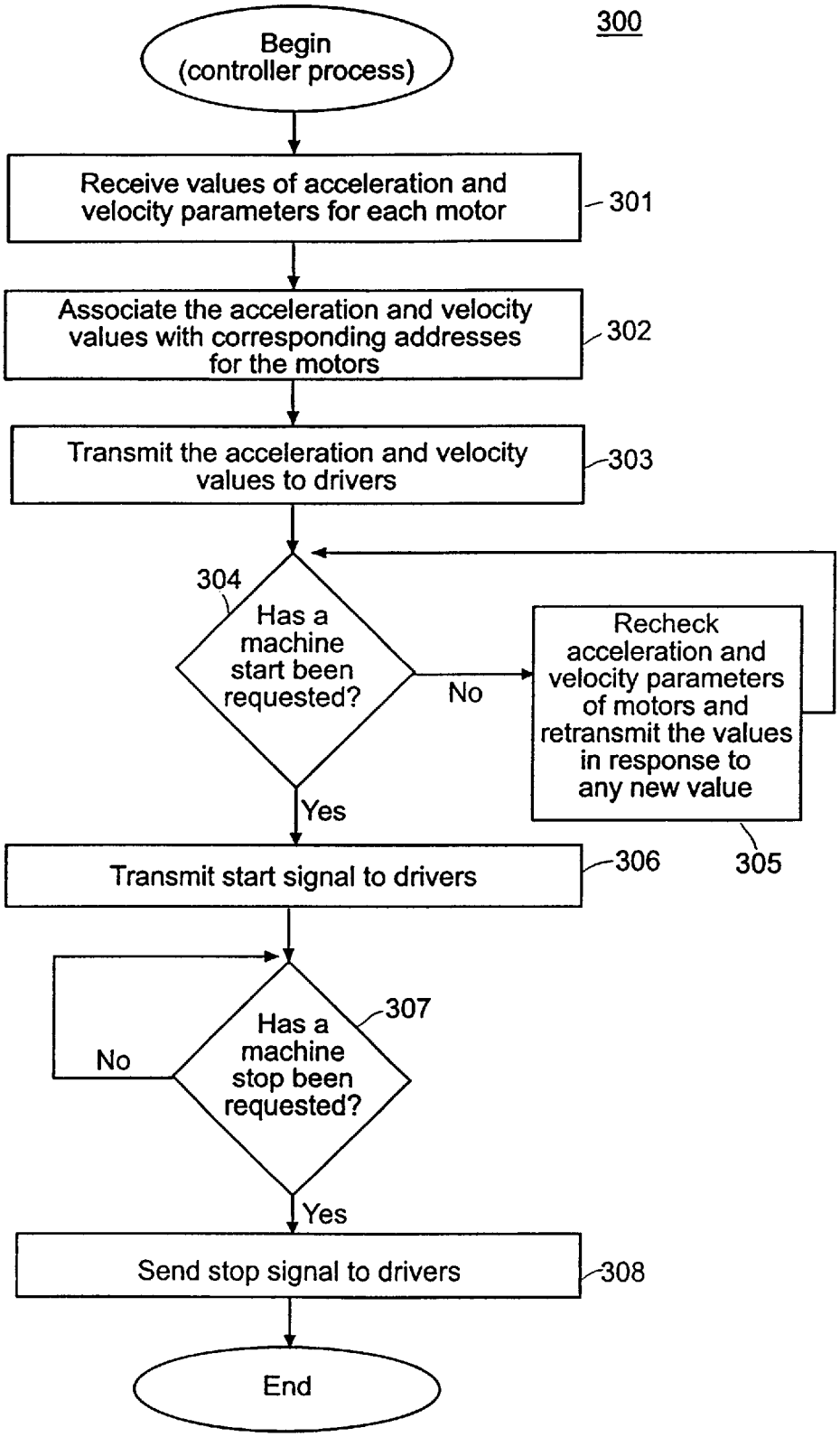
FIGS. 3A and 3B are flow charts of processing to control motors in a first embodiment using signal addressing.
Figure 3B:
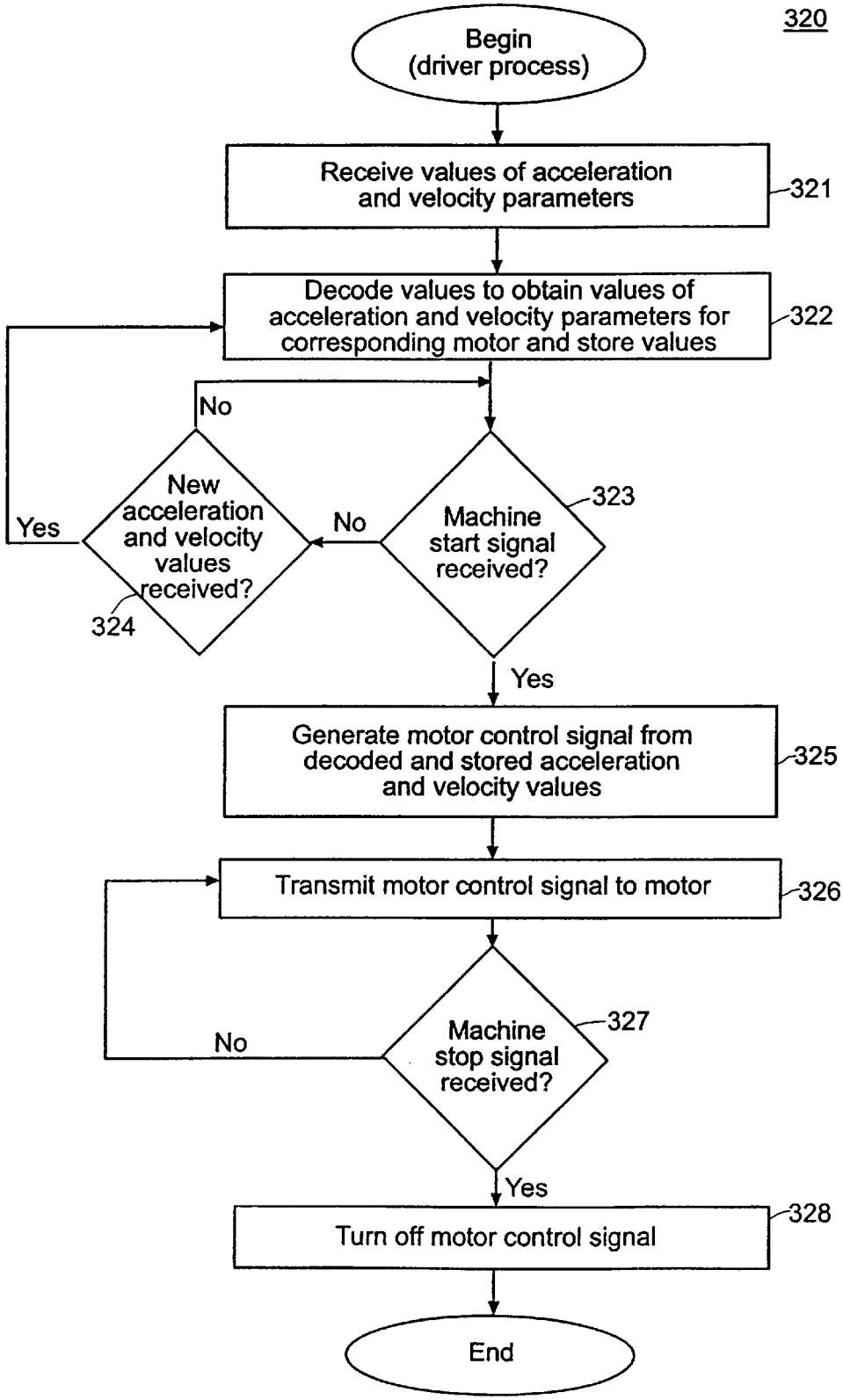

FIGS. 3A and 3B are flow charts of processes for controlling motors 207–212 in a first embodiment. These processes may be implemented by processor 231 accessing a program in memory 232 to implement the functions of the flow chart (FIG. 3A) for controller operation and by processors in each of the drivers 213–218 accessing a program in the associated memories for driver operation (FIG. 3B), such as processor 219 accessing a program in memory 220. Each of the flow charts illustrates these functions in a series of blocks. Therefore, these processes may be implemented by software modules stored in memory 232 and the driver memories, or received from another source, or alternatively by hardware modules or a combination of software and hardware modules. In addition, the program or other information for executing the processes may also be stored on or read from other types of computer program products or computer-readable media, such as secondary storage devices, including hard disks, floppy disks, or CD-ROM; a signal from a network; or other forms of RAM or ROM. The computer-readable media may include instructions for controlling a computer system, such as processor 231 and the driver processors, to perform a particular method such as that shown in FIGS. 3A and 3B.

FIG. 3A is a flow chart of processing within controller 230, and FIG. 3B is a flow chart of associated processing in drivers 213–218. In process 300, controller 230 receives values of velocity and acceleration parameters or related information from input device 233 (block 301), and it associates the velocity and acceleration values for each motor with the corresponding addresses for motors 207–212 (block 302). Controller 230 transmits the velocity and acceleration values to drivers 213–218 via connections 221 using the stored addresses for the corresponding motors (block 303). Controller 230 may generate and provide acceleration and velocity values for each individual motor and may store such values in a data structure in memory 232 or other location for association with the addresses for the motors, as shown in Table 2.

TABLE 2

| | Motor |
|---|---|
| Velocity Value | |
| Velocity 1 | Feeder motor |
| Velocity 2 | First backfold motor |
| Velocity 3 | Second backfold motor |
| Velocity 4 | Final fold motor |
| Velocity 5 | Delivery motor |
| Velocity 6 | Compression motor |
| Acceleration Value | |
| Acceleration 1 | Feeder motor |
| Acceleration 2 | First backfold motor |
| Acceleration 3 | Second backfold motor |
| Acceleration 4 | Final fold motor |
| Acceleration 5 | Delivery motor |
| Acceleration 6 | Compression motor |

Controller 230 determines if a machine start has been requested (block 304), which may occur through input device 233. A machine start is typically requested through an entered signal instructing controller 230 to start a carton folding process in machine 200 through control of motors 207–212. If a machine start has not been requested, controller 230 rechecks acceleration and velocity parameters of the motors and retransmits values of them to the drivers in response to any new value (block 305), as the values may have changed based upon new user-entered information at input device 233. If a machine start has been requested, controller 230 in response transmits a start signal to drivers 213–218 (block 306). A start signal is a signal transmitted to drivers 213–218 via connections 221 instructing the drivers to begin operation of the associated motors using the velocity and acceleration values in order to initiate a carton folding process in machine 200. Controller 230 determines if a machine stop has been requested (block 307) and, if so, it transmits a stop signal to drivers 213–218 to stop the motors (block 308). A stop signal is a signal transmitted to drivers 213–218 indicating a halt or completion of a carton folding process.

FIG. 3B is a flow chart of an associated process 320 for each of the drivers 213–218. In process 320, each of the drivers 213–218 receives values of acceleration and velocity parameters from controller 230 via connections 221 (block 321). Each of the drivers 213–218 performs any decoding required to translate the velocity and acceleration values into corresponding electronic signals for controlling operation of motors 207–212 and stores the values (block 322). Decoding may be required, for example, if controller 230 transmits values mathematically or logically related to acceleration and velocity values for the motors. Each of the drivers 213–218 determines if a machine start signal has been received from controller 230 (block 323); if not, they determine if new acceleration and velocity values have been received (block 324). If the drivers 213–218 have received new acceleration and velocity values, they perform the function shown in block 322 to decode the new acceleration or velocity signal and update the acceleration and velocity values for the corresponding motors.

If the drivers 213–218 receive a machine start signal, they each generate a motor control signal from the decoded and stored acceleration and velocity values (block 325). A motor control signal is an electronic signal transmitted to a motor to control operation of the motor, and the generation of motor control signals from velocity and acceleration values depends upon a particular type of motor used. A driver for a particular type of motor, such as the exemplary controllers and drivers identified above, typically automatically generates motor control signals from entered velocity and acceleration values. Each of the drivers 213–218 transmits the motor control signals to the corresponding motor (block 326) monitors connections 221 to determine if a machine stop signal has been received (block 327). If they receive a machine stop signal, each of the drivers 213–218 turns off the corresponding motor control signal to stop operation of machine 200 (block 328).

Second Embodiment: Electronic Gear Ratios

A second embodiment uses electronic gear ratios, also referred to as electronic line shafting or ELS, for generating individual velocity and acceleration values for the motors. An exemplary method and apparatus for this embodiment includes receiving a master reference signal and values of velocity parameters for controlling a plurality of motors within a carton folding machine. Ratios are determined from the master reference signal and the values for generating motor control signals from the master reference signal for individually controlling the plurality of motors. The motor control signals are provided to the plurality of motors based upon the master reference signal and the ratios.

Figure 4A:
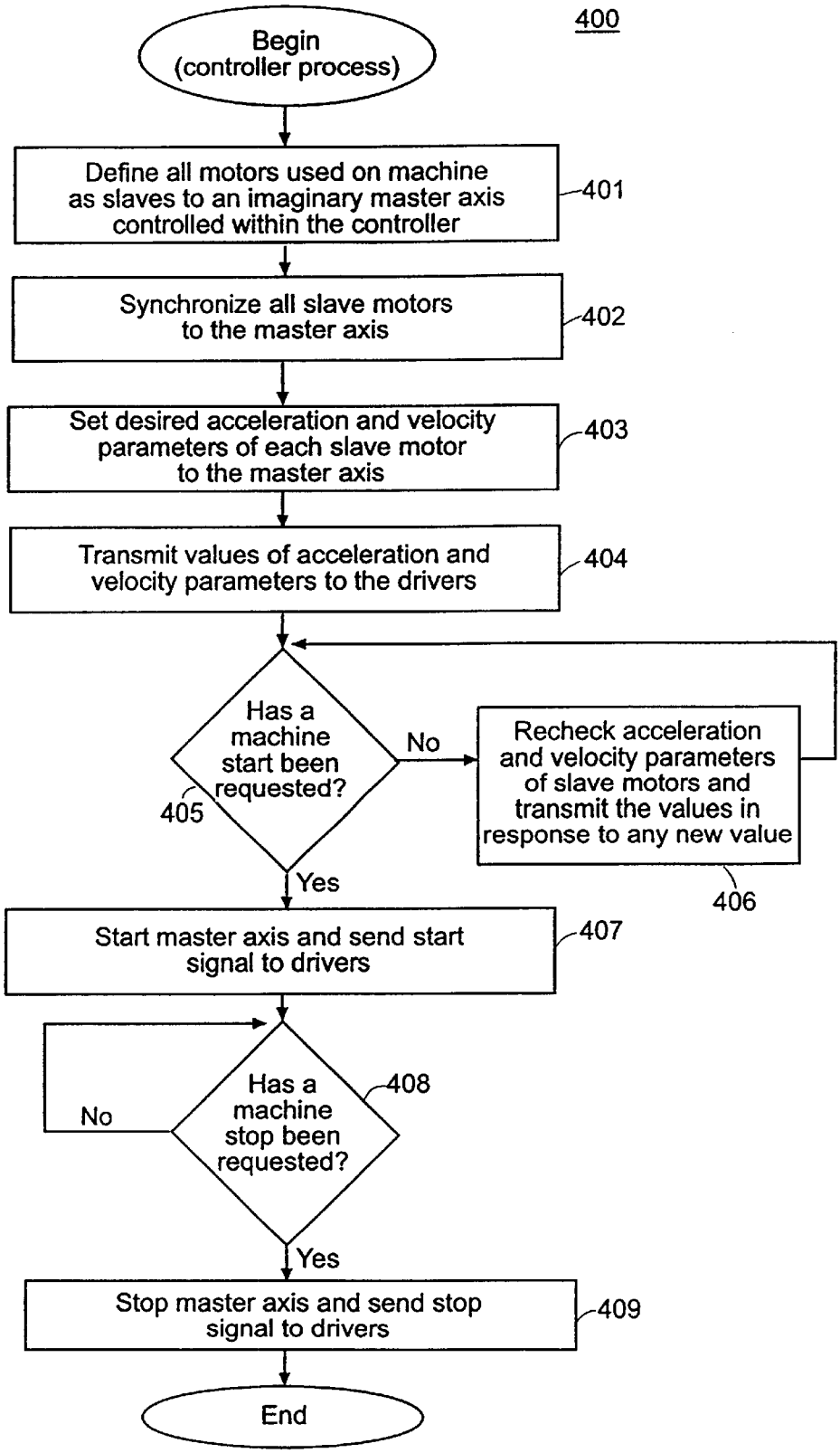
FIGS. 4A and 4B are flow charts of processing to control motors in a second embodiment using electronic gear ratios.
Figure 4B:
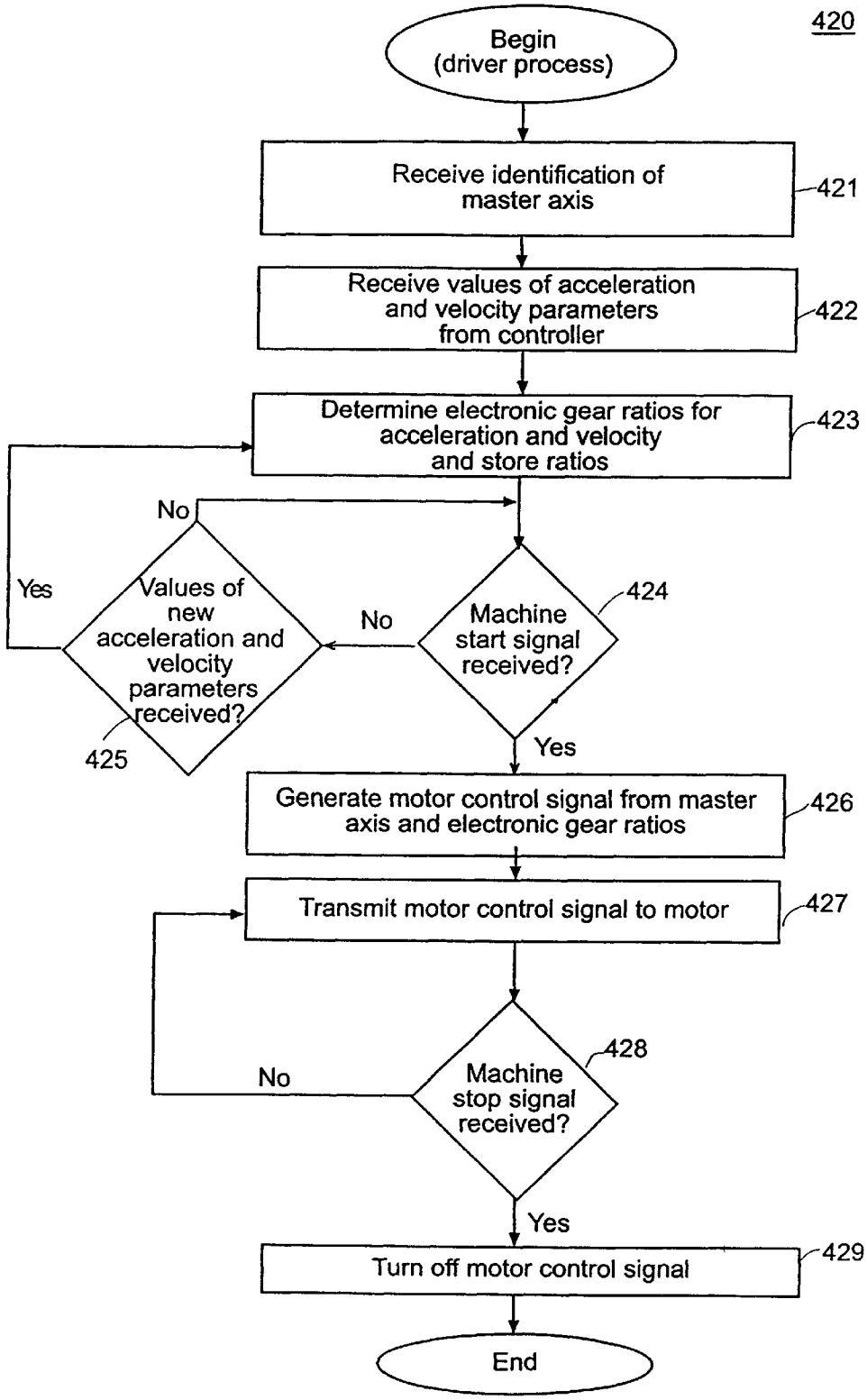

FIGS. 4A and 4B are flow charts of processes for controlling motors 207–212 in a second embodiment. These processes may be implemented by processor 231 accessing a program in memory 232 to implement the functions of the flow chart (FIG. 4A) for controller operation and by processors in each of the drivers 213–218 accessing a program in the associated memories for driver operation (FIG. 4B), such as processor 219 accessing a program in memory 220. Each of the flow charts illustrates these functions in a series of blocks. Therefore, these processes may be implemented by software modules stored in memory 232 and the driver memories, or received from another source, or alternatively by hardware modules or a combination of software and hardware modules. In addition, the program or other information for executing the processes may also be stored on or read from other types of computer program products or computer-readable media, such as secondary storage devices, including hard disks, floppy disks, or CD-ROM; a signal from a network; or other forms of RAM or ROM. The computer-readable media may include instructions for controlling a computer system, such as processor 231 and the driver processors, to perform a particular method such as that shown in FIGS. 4A and 4B.

FIG. 4A is a flow chart of processing within controller 230, and FIG. 4B is a flow chart of associated processing in drivers 213–218. In process 400, controller 230 defines motors 207–212 used on machine 200 as slaves to an imaginary master axis or reference controlled within controller 230 (block 401), which may occur based on user-entered input from input device 233. Controller 230 in conjunction with drivers 213–218 synchronizes slave motors 207–212 to the master axis (block 402). Controller 230 sets values of the desired acceleration and velocity parameters for slave motors 207–212 to the master axis (block 403) and transmits the information to the drivers 213–218 via connections 221 for the drivers to determine and save corresponding ratios (block 404). Controller 230 may generate and store in a data structure in memory 232 or other location, as shown in Table 2, velocity and acceleration signals for each motor.

Controller 230 determines if a machine start has been requested (block 405), which may be requested through input device 233. A machine start is typically requested through an entered signal instructing controller 230 to start a carton folding process in machine 200 through control of motors 207–212. If a machine start has not been requested, controller 230 rechecks the values of the acceleration and velocity parameters of slave motors 207–212 and retransmits values of them to the drivers in response to any new value (block 406), as the values may have changed based upon new user-entered information at input device 233. If a machine start has been requested, controller 230 in response starts the master axis and provides a start signal to drivers 213–218 via connections 221 indicating start of the master axis (block 407). A start signal is a signal transmitted to drivers 213–218 via connections 221 instructing the drivers to begin operation of the associated motors using the velocity and acceleration values in order to initiate a carton folding process in machine 200. Controller 230 determines if a machine stop has been requested (block 408) and, if so, it stops the master axis and transmits a stop signal to drivers 213–218 via connections 221 (block 409). A stop signal is a signal transmitted to drivers 213–218 indicating a halt or completion of a carton folding process.

FIG. 4B is a flow chart of an associated process 420 for each of the drivers 213–218. In process 420, drivers 213–218 each receive an identification of the master axis or reference including information indicating a velocity of the master axis (block 421). They also receive values of acceleration and velocity parameters for their corresponding motors (block 422). Each of the drivers 213–218 determines electronic gear ratios for acceleration and velocity of the motors they control, and they store those ratios in their associated memories (block 423).

In particular, knowing the velocity of the master axis and desired velocity and acceleration of each motor, drivers 213–218 each determine a ratio of the master axis to achieve the desired velocity and acceleration. The desired velocity equals the master axis velocity times a particular ratio. For example, if the desired velocity is twice the velocity of the master axis, the ratio will be two to one, and the driver will obtain the motor velocity by multiplying the master axis velocity by two. The ratio may also be less than one in order to implement a motor velocity less than the master axis velocity. Acceleration values may also be obtained as a function of the master axis velocity. Accordingly, the term ratio (or electronic gear ratio) includes any value or indicator used to generate a resultant value based upon a reference value, in this example an indication of velocity or acceleration based upon a master reference signal.

Alternatively, controller 230 may calculate the ratios and transmit them instead of transmitting acceleration and velocity values. Controller 230 may calculate the ratios in the same manner as the drivers by determining the acceleration and velocity values as a function of the master reference signal, and it may store the ratios in a data structure in memory 232 or other location for retrieval and transmission to the drivers, as shown in Table 3.

TABLE 3

| | Motor | ratio |
|---|---|---|
| Velocity Value | | |
| Velocity 1 | Feeder motor | velocity ratio 1 |
| Velocity 2 | First backfold motor | velocity ratio 2 |
| Velocity 3 | Second backfold motor | velocity ratio 3 |
| Velocity 4 | Final fold motor | velocity ratio 4 |
| Velocity 5 | Delivery motor | velocity ratio 5 |
| Velocity 6 | Compression motor | velocity ratio 6 |
| Acceleration Value | | |
| Acceleration 1 | Feeder motor | acceleration ratio 1 |
| Acceleration 2 | First backfold motor | acceleration ratio 2 |
| Acceleration 3 | Second backfold motor | acceleration ratio 3 |
| Acceleration 4 | Final fold motor | acceleration ratio 4 |
| Acceleration 5 | Delivery motor | acceleration ratio 5 |
| Acceleration 6 | Compression motor | acceleration ratio 6 |

Each of the drivers 213–218 monitors connections 221 to determine if a machine start signal has been transmitted from controller 230 (block 424). If they do not receive a machine start signal, they determine if new acceleration and velocity values have been transmitted (block 425) and, if so, recalculate the electronic gear ratios (block 423).

If the drivers 213–218 do receive a machine start signal, as determined in block 424, they each generate a motor control signal using the master axis and the stored electronic gear ratios (block 427) and transmit the motor control signal to the corresponding motor (block 427). A motor control signal is an electronic signal transmitted to a motor to control operation of the motor, and the generation of motor control signals from velocity and acceleration values depends upon a particular type of motor used. A driver for a particular type of motor, such as the exemplary controllers and drivers identified above, typically automatically generates motor control signals from entered velocity and acceleration values. The drivers 213–218 continue to provide the motor control signals to their motors until they detect a machine stop signal from controller 230 (block 428). In response to the machine stop signal, each of the drivers 213–218 turns off the motor control signal to stop operation of machine 200 (block 429).

While the present invention has been described in connection with an exemplary embodiment, it will be understood that many modifications will be readily apparent to those skilled in the art, and this application is intended to cover any adaptations or variations thereof. For example, different carton folding machines, controllers, input devices, and display devices may be used without departing from the scope of the invention. This invention should be limited only by the claims and equivalents thereof.

What is claimed is:

1. A method for individually controlling motors in a carton folding machine having a plurality of cooperating sections each controlled by a motor, comprising:

receiving values of velocity parameters relating to controlling a plurality of motors within the carton folding machine for a process of folding and assembling a carton through the plurality of cooperating sections;

automatically generating from the velocity values motor control signals for individually controlling the plurality of motors for the process of folding and assembling the carton through the plurality of cooperating sections; and automatically transmitting the motor control signals to the plurality of motors in order to control the motors for automatically executing the process of folding and assembling the carton through the plurality of cooperating sections.

2. The method of claim 1 wherein the receiving includes automatically rechecking the values of the velocity parameters.

3. The method of claim 1, further including receiving a start signal for initiating the automatically generating step and the automatically transmitting step.

4. The method of claim 3, further including continuously performing the automatically transmitting step until receiving a stop signal.

5. The method of claim 1 wherein:

the receiving includes receiving values of acceleration parameters relating to controlling the plurality of motors; and the generating includes automatically generating from the acceleration values and the velocity values the motor control signals.

6. An apparatus for individually controlling motors in a carton folding machine having a plurality of cooperating sections each controlled by a motor, comprising:

a module for receiving values of velocity parameters relating to controlling a plurality of motors within the carton folding machine for a process of folding and assembling a carton through the plurality of cooperating sections;

a module for automatically generating from the velocity values motor control signals for individually controlling the plurality of motors for the process of folding and assembling the carton through the plurality of cooperating sections; and a module for automatically transmitting the motor control signals to the plurality of motors in order to control the motors for automatically executing the process of folding and assembling the carton through the plurality of cooperating sections.

7. The apparatus of claim 6 wherein the receiving module includes a module for automatically rechecking the values of the velocity parameters.

8. The apparatus of claim 6, further including a module for receiving a start signal for initiating the automatically generating module and the automatically transmitting module.

9. The apparatus of claim 8, further including a module for continuously performing the automatically transmitting until receiving a stop signal.

10. The apparatus of claim 6 wherein:

the receiving module includes a module for receiving values of acceleration parameters relating to controlling the plurality of motors; and the generating module includes a module for automatically generating from the acceleration values and the velocity values the motor control signals.

11. A system for individually controlling motors in a carton folding machine having a plurality of cooperating sections each controlled by a motor, comprising:

a carton folding machine including a plurality of motors controlling a plurality of cooperating sections;

a plurality of drivers coupled to the plurality of motors; and a controller coupled to the plurality of drivers, wherein the controller and the plurality of drivers cooperatively operate to:

receive values of velocity parameters relating to controlling the plurality of motors within the carton folding machine for a process of folding and assembling a carton through the plurality of cooperating sections;

automatically generate from the velocity values motor control signals for individually controlling the plurality of motors for the process of folding and assembling the carton through the plurality of cooperating sections; and automatically transmit the motor control signals to the plurality of motors in order to control the motors for automatically executing the process of folding and assembling the carton through the plurality of cooperating sections.

12. A method for individually controlling motors in a carton folding machine having a plurality of cooperating sections each controlled by a motor, comprising:

receiving a master reference signal and values of velocity parameters for controlling a plurality of motors within the carton folding machine for a process of folding and assembling a carton through the plurality of cooperating sections;

automatically determining from the master reference signal and the values ratios and automatically generating motor control signals from the master reference signal, using the ratios, for individually controlling the plurality of motors for the process of folding and assembling the carton through the plurality of cooperating sections; and automatically transmitting the motor control signals to the plurality of motors in order to control the motors for automatically executing the process of folding and assembling the carton through the plurality of cooperating sections.

13. The method of claim 12 wherein the receiving includes automatically rechecking the values of the velocity parameters.

14. The method of claim 12, further including receiving a start signal for initiating the automatically generating step and the automatically determining and transmitting step.

15. The method of claim 14, further including continuously performing the automatically transmitting step until receiving a stop signal.

16. The method of claim 12 wherein:

the receiving includes receiving values of acceleration parameters relating to controlling the plurality of motors; and the determining includes automatically determining from the acceleration values and the velocity values the ratios.

17. An apparatus for individually controlling motors in a carton folding machine having a plurality of cooperating sections each controlled by a motor, comprising:

a module for receiving a master reference signal and values of velocity parameters for controlling a plurality of motors within the carton folding machine for a process of folding and assembling a carton through the plurality of cooperating sections;

a module for automatically determining from the master reference signal and the values ratios and automatically generating motor control signals from the master reference signal, using the ratios, for individually controlling the plurality of motors for the process of folding and assembling the carton through the plurality of cooperating sections; and a module for automatically transmitting the motor control signals to the plurality of motors in order to control the motors for automatically executing the process of folding and assembling the carton through the plurality of cooperating sections.

18. The apparatus of claim 17 wherein the receiving module includes a module for automatically rechecking the values of the velocity parameters.

19. The apparatus of claim 17, further including a module for receiving a start signal for initiating the automatically generating module and the automatically determining and transmitting module operation of the motors.

20. The apparatus of claim 19, further including a module for continuously performing the automatically transmitting until receiving a stop signal.

21. The apparatus of claim 17 wherein:

the receiving module includes a module for receiving values of acceleration parameters relating to controlling the plurality of motors; and the determining module includes a module for automatically determining from the acceleration values and the velocity values the ratios.

22. A system for individually controlling motors in a carton folding machine having a plurality of cooperating sections each controlled by a motor, comprising:

a carton folding machine including a plurality of motors controlling a plurality of cooperating sections;

a plurality of drivers coupled to the plurality of motors; and a controller coupled to the plurality of drivers, wherein the controller and the plurality of drivers cooperatively operate to:

receive a master reference signal and values of velocity parameters for controlling the plurality of motors within the carton folding machine for a process of folding and assembling a carton through the plurality of cooperating sections;

automatically determine from the master reference signal and the values ratios and automatically generate motor control signals from the master reference signal, using the ratios, for individually controlling the plurality of motors for the process of folding and assembling the carton through the plurality of cooperating sections; and automatically transmit the motor control signals to the plurality of motors in order to control the motors for automatically executing the process of folding and assembling the carton through the plurality of cooperating sections.

23. A method for individually controlling motors in a carton folding machine having a plurality of cooperating sections each controlled by a motor, comprising:

receiving values of velocity parameters relating to controlling a plurality of motors within the carton folding machine for a process of folding and assembling a carton through the plurality of cooperating sections, each of the motors having an axis for rotation;

generating from the velocity values motor control signals for individually controlling the plurality of motors for the process of folding and assembling the carton through the plurality of cooperating sections; and transmitting the motor control signals to the plurality of motors in order to control the motors for automatically executing the process of folding and assembling the carton through the plurality of cooperating sections without requiring lateral movement of the axis for each of the motors.

24. A method for individually controlling motors in a carton folding machine having a plurality of cooperating sections each controlled by a motor, comprising:

receiving a master reference signal and values of velocity parameters for controlling a plurality of motors within the carton folding machine for a process of folding and assembling a carton through the plurality of cooperating sections, each of the motors having an axis for rotation;

determining from the master reference signal and the values ratios and generating motor control signals from the master reference signal, using the ratios, for individually controlling the plurality of motors for the process of folding and assembling the carton through the plurality of cooperating sections; and transmitting the motor control signals to the plurality of motors in order to control the motors for automatically executing the process of folding and assembling the carton through the plurality of cooperating sections without requiring lateral movement of the axis for each of the motors.

* * * * *